United States Patent [19]

Stauffer et al.

[11] Patent Number: 4,798,046

[45] Date of Patent: Jan. 17, 1989

[54] OPENING CYLINDER FOR OPEN-END SPINNING MACHINES

[76] Inventors: Jörg Stauffer, Eigenrain 6, CH-4107 Ettingen; Hans Riethmann, Jr., Breitestrasse 28, CH-8614 Bertschikon, both of Switzerland

[21] Appl. No.: 882,681

[22] Filed: Jul. 7, 1986 (Under 37 CFR 1.47)

[30] Foreign Application Priority Data

Jul. 6, 1985 [CH] Switzerland ..... 02922/85

[51] Int. Cl.[4] ..... D01H 7/895; D01G 9/14; D01G 15/20; D01G 15/26

[52] U.S. Cl. ..... 57/408; 19/97; 19/105; 19/112

[58] Field of Search ..... 57/404, 408–411; 19/82, 83, 97, 98, 100, 101, 105, 112, 115 R

[56] References Cited

U.S. PATENT DOCUMENTS

| | | | |
|---|---|---|---|
| 3,737,951 | 6/1973 | Mackie | 19/97 |
| 4,122,656 | 10/1978 | Shaw | 57/408 |
| 4,135,355 | 1/1979 | Stewart | 57/408 |
| 4,249,286 | 2/1981 | Stalder | 19/97 |
| 4,530,133 | 7/1985 | Stewart et al. | 19/112 X |

*Primary Examiner*—John Petrakes
*Attorney, Agent, or Firm*—Lalos & Keegan

[57] ABSTRACT

The opening cylinder comprising a cylindrical ring serving as a needle support and being provided with needle-housing bores extending from the inner ring surface to the outer one is designed to carry needles comprising a point section of generally tapered shape and a shaft section, the latter being pressed into and seated with force fit in a radially inner section of a corresponding one of said bores. A radially outer section of the bore surrounds a portion of said needle point section so as to form an annular groove therearound at the orifice of the bore in the outer ring surface. The radially inner section of the bore or at least part thereof has a diameter which is at least as great as the diameter of the outer section of the bore in the range of its orifice in the outer ring surface. This ensures having a simple and inexpensive needle mounting which a precise positioning of the needle tips.

12 Claims, 3 Drawing Sheets

OPENING CYLINDER FOR OPEN-END SPINNING MACHINES

BACKGROUND OF THE INVENTION

It is well known that opening cylinders for open-end spinning machines are equipped with a cylindrical ring serving as a needle support and having radial borings into which the needles are inserted, each of said needles consisting of a cylindrical needle shaft and a tapered needle point. In the context of needle rings of this kind, it is also well known to provide them with graduated borings for the needles, that is to say with borings which show in the outer ring surface a substantially bigger diameter than the needles, in order to avoid that the material to be manufactured adheres and that thereby the needle ring is provided with a felted coating covering the needle points.

This construction is quite expensive because of the fact that for each boring two cycles of operations are necessary. In addition, this construction has the disadvantage that the needles, the shaft length of which amounts only to approximately ⅔ of the depth of the borings, are merely held on this length so that they may get loose and, due to the great centrifugal forces, be thrown out.

SUMMARY OF THE INVENTION

The opening cylinder according to the present invention serves to surmount the drawbacks of the known devices with regard to the desired low-cost mounting of the needles due to the possibility of using simple and inexpensively to produce bores in the ring member without a shoulder to machine in each bore. The most advantageous shape of the bore in this respect is cylindrical throughout the ring thickness, while a slightly conical shape with a diameter decreasing from the inner to the outer ring surface may be preferable with regard to highduty stability of the needle mounting under rough operational conditions. The last-mentioned embodiment still shows comparatively low manufacturing expenses. In any case there is the advantage of automatically establishing not only a press fit, but also a form fit connection between the needle and the ring, this connection being effective against centrifugal forces trying to throw out the needles. Such form fit connection is established merely by pressing the needle shaft sections into the radially inner sections of their bores respectively, i.e. from the inner ring surface, and will be of enhanced stability due to the fact that the adjacent radially outer section of the bores will have a lesser diameter even in case of an originally cylindrical throughout-bore, however, of a still enhanced stability when using an originally conical bore as mentioned above. The portion of the radially outer bore section located adjacent the shaft receiving inner bore section due to its elasticity will tend to remain contracted to its original diameter against the diameter-expanding forces transmitted by shear stress from the adjacent portion of the inner bore section receiving the needle shaft section. This effect establishes the formation of an axially effective form fit connection between needle and ring, and particularly under appropriately selected mounting conditions and dimensions the formation of a shoulder or bead axially supporting the outer end edge of the needle shaft section. A further essential advantage of the invention is the simple formation of an annular groove around the needle point section within the outer ring surface without any multiple drilling or stepdrilling operations. Such annular groove serves in a manner principally known per se to avoid adhering of fibres from the material to be treated by the opening cylinder to the needles and to avoid the formation of a disturbing felt layer at the needle tips. Particularly it has been revealed by thorough investigations that the acute angle at the bottom of the annular grooves formed between a cylindrical or slightly conical bore section and a tapered needle point section does not affect the desired cleaning effects of the groove.

BRIEF DESCRIPTION OF THE DRAWING

The drawings depict schematically embodiments of the present invention which will be described in detail hereinafter. In the drawings there is shown.

DESCRIPTION OF A PREFERRED EMBODIMENT

Figure 1:
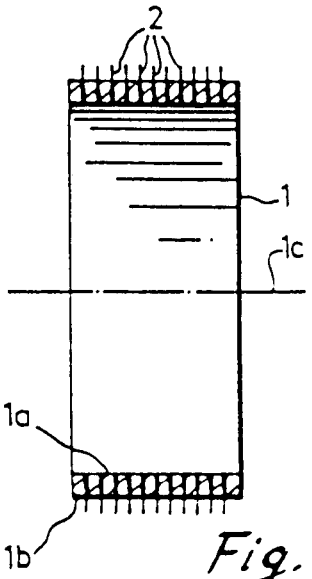
FIG. 1 a cross-section of a ring formed as a needle support.
Figure 2:
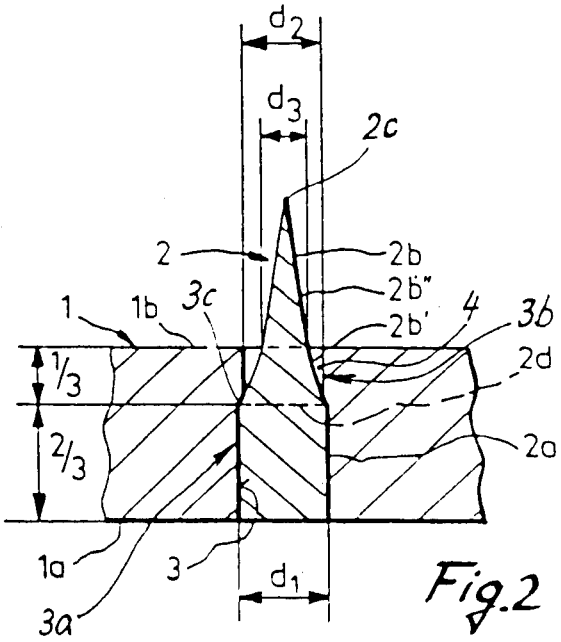
FIG. 2 a portion of this ring on an enlarged scale.

The ring, depicted in FIG. 1 and as a whole referred to as 1, is equipped with needles 2. The details of the ring 1 are shown in FIG. 2. Each needle has a cylindrical shaft section 2*a* and a tapered point section 2*b*.

For each needle, the ring 1 possesses a straight bore 3. As can be seen from the drawing, these borings do not have a completely cylindrical shape. They are, on the contrary, slightly conical, namely in such a manner that the diameter d1 at the inner ring surface 1*a* is approximately 5% bigger than the diameter d2 at the outer ring surface 1b. In contrast with the boring 3, the needle shaft is cylindrical. Its diameter is imperceptibly smaller than the bigger diameter d1 of the boring 3, but only to such an extent that the needle shaft, although it may be inserted into the boring from the side of the opening cylinder axis 1*c*, can only be placed completely within the boring by means of an expenditure of energy and by deforming the boring 3.

As one can see from the drawing, the length of the needle shaft 2*a* amounts to ⅔ of the length of the boring 3. The tapered point section 2*b*, being adjacent to the shaft section consists of two portions with differing slenderness. The portions 2*b*'' protruding over the outer ring surface 1*b* shows an eminently greater slenderness than the portions 2*b*' adjacent to the shaft section 2*a*. Supposing, for example, that the whole needle has a length of 5.5 mm and the boring a length of 3 mm and that therefore a point portion having a length of 2.5 mm is protruding over the outer ring surface 1*b*, then the biggest diameter d3 of this point portion amounts to approximately 0.5 mm, provided that the thickness of the needle is 1.04 mm. The adjacent portion joining this slender point portion to the shaft section 2*a* may then have a length of 1 mm. Its diameter increases in the direction towards the axis of the ring from 0.5 mm to a bit more than double the size, that means to the aforementioned 1.04 mm. Besides, it is very useful if the broadening in the direction towards the shaft increases progressively because, in this way, it will be possible to make portion 2*b*′ overlap with portion 2*b*″ without forming any edges, whereas between the cylindrical shaft section 2*a* and the adjacent portion 2*b*′, there is provided for an edge 2*d*. As can be easily deduced from the drawing, this edge entails that the needle 2 may only be completely pressed into the boring 3 through the application of a continuously increasing force, so that, even at a very great number of revolutions, there is no risk that the needle may get loose and be thrown out, when the opening cylinder is in operation. At the same time, the above described form of the needle has the advantage that, notwithstanding the fact that the boring is not graduated, there is to be found an annular free space between the needle 2 and the boring, which, as is generally known, prevents the fibers from "adhering", so that a greater reliability in operation may be achieved despite of lower manufacturing costs.

Figure 3:
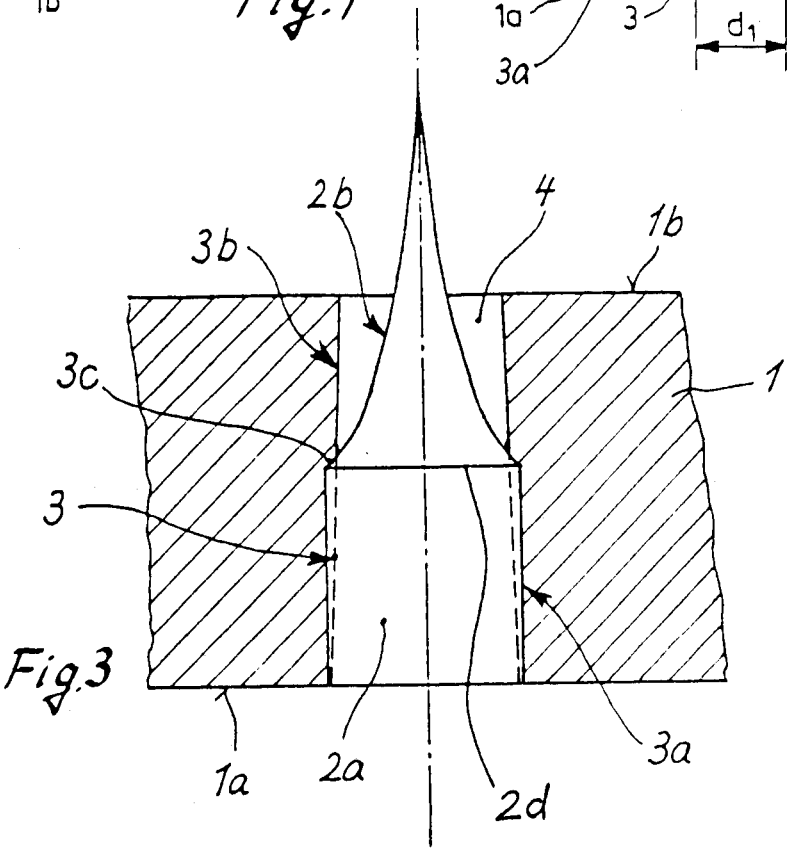
FIG. 3 an axial part-section representation of one needle with its mounting in a ring bore, similar to FIG. 1, but in a still enlarged scale, FIG. 4 a second embodiment of needle and needle-mounting in a representation as in FIG. 3, with a needle having a stepped point section profile, FIG. 5 an embodiment of needle and needle mounting with a unitary conical needle point section, in a representation as in FIG. 3, and FIG. 6 an embodiment with a conical needle shaft section, also in a representation as in FIG. 3.

The further enlarged sectional view of FIG. 3 shows additionally the undeformed shape of bore 3 in a state before the needle shaft section 2*a* has been pressed therein. This original shape of the bore is different from the one established by insertion of the needle as far as a correspondingly radially inner section 3*a* of bore 3 is concerned. Within this section the original shape has been depicted by dashed lines. Over outer section 3*b* of the bore there is—roughly speaking—no difference between the shapes before and after insertion of the needle. However, a shoulder or bead 3*c* is formed by such insertion under pressure, this shoulder or bead supporting the edge portion 2*d* at the outer end of needle shaft section 2*a* by form fit against centrifugal forces acting on the needle. Moreover, there may be—and regularly is—formed a real bead within the bore surface due to displacement of material of ring 1, which bead protrudes somewhat over the undeformed bore surface radially inwards with regard to the bore or needle axis, thus forming a portion of the bore with a reduced diameter. The result is an enhanced support surface acting by form fit against the front of edge 2*d*. All this takes part in an enhanced mounting stability and positioning accuracy of the needles, thus making possible that the tips 2*c* of all needles in one ring are located on a common cylindrical ideal surface with comparatively small deviations.

Furthermore, FIGS. 2 and 3 show the formation of an annular groove 4 by the bore section 3*b* surrounding the inner portion 2*b*′ of needle point section 2*b* with radial distance (here: radially with regard to the bore or needle axis). The profile of annular groove 4 seen in a view on a sectional plane along the needle or bore axis, ends under an acute angle at the bottom of the groove. Surprisingly it has been found on thorough and multiple experiments that such sharp-angled ciscumferential bottom edge of groove 4 by no means affects the cleaning effects of such groove. To the contrary, certain considerations might lead to the result that such sharp-angled concave groove edge has beneficial effects with regard to avoiding fibres to tangle on the needle tips and forming a layer of felt.

Figure 4:
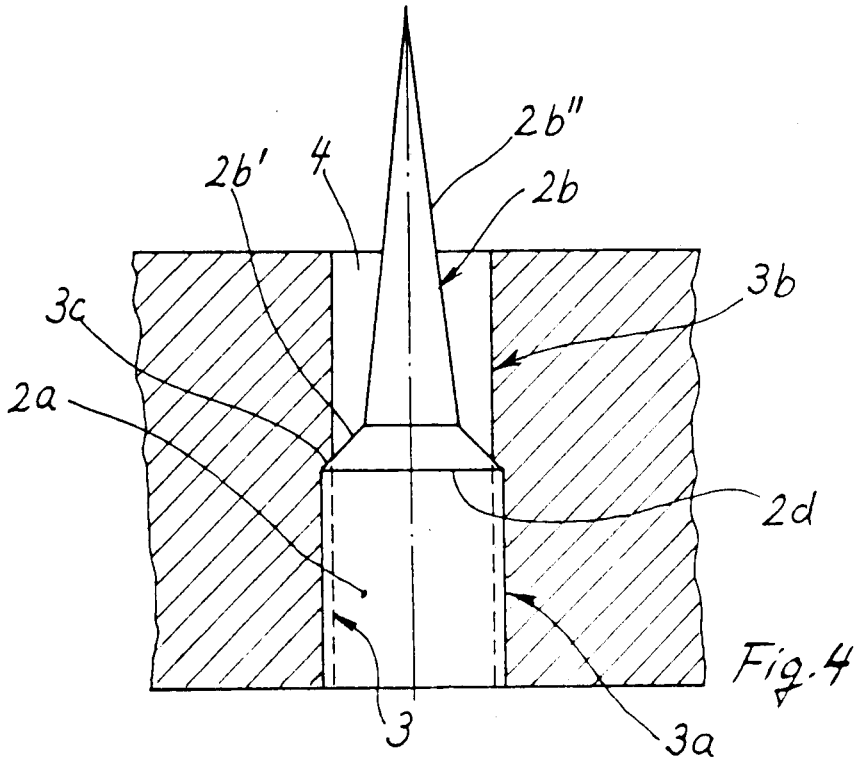
Figure 5:
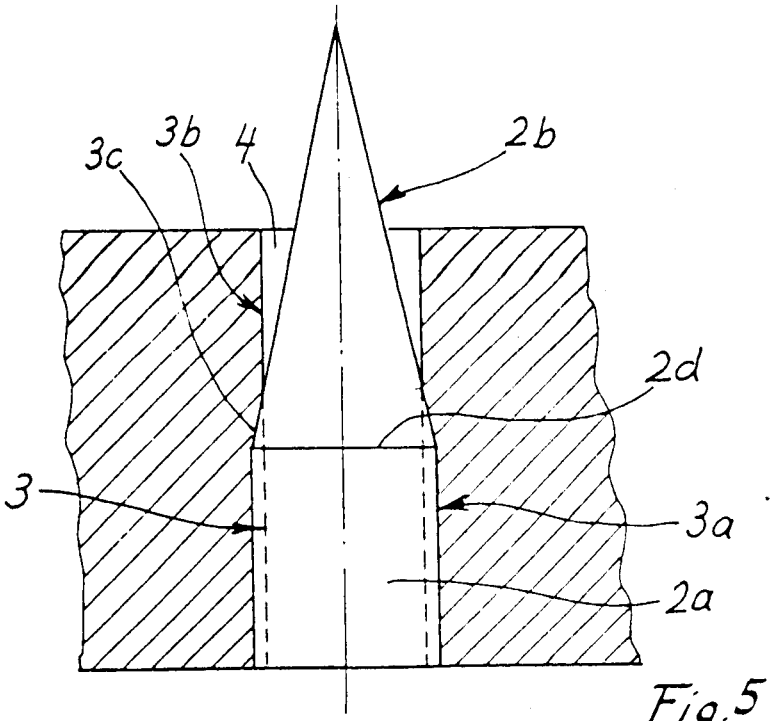
Figure 6:
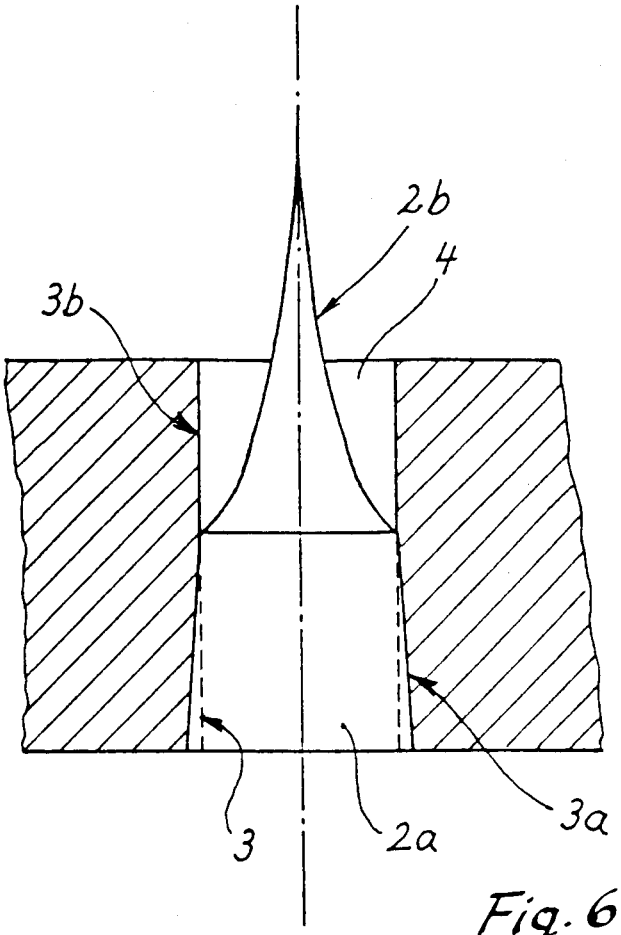

In the representations of FIGS. 4 to 6 the same reference numerals as in FIGS. 1 to 3 have been adopted for elements corresponding with each other in the different, but similar embodiments.

Having the effects and explanations concerning the embodiment according to FIGS. 1 to 3 in mind, the embodiments according to FIGS. 4 to 6 differ therefrom firstly by the cylindrical shape of the original bore 3 (dashed lines within bore section 3*a*). This has the striking advantage of minimum production expenses. Moreover, the stepped profile of needle point section 2*b* in its portions 2*b*′ and 2*b*″ according to FIG. 4 offers the possibility of a comparatively broad groove profile at the bottom of groove 4, which might be advisable in certain applications. Regularly, however, a simple and inexpensively to produce conical needle point profile according to FIG. 5 will sufficiently fulfill the desired function. The comparatively small groove profile will suffice also in most cases. Both embodiments—FIGS. 4 and 5—offer the same basic advantage with regard to the formation of a shoulder or bead 3*c* by insertion of the needle shaft section, and thus a form fit support connection between needle and ring body. Besides, the needle point profiles according to FIGS. 4 and 5 in general are like wise applicable with a slightly conical bore as supposed in the embodiment of FIG. 3.

Finally, FIG. 6 shows an embodiment with a slightly conical needle point section 2*a*, pressed into a cylindrical inner bore section 3*a*. The latter thereby is expanded to a conical shape congruent with the needle shaft section, while strong pressure stresses distributed over the length of the needle shaft are generated. This embodiment also achieves form fit support besides the force fit, thus securing the needles against centrifugal forces. A special advantage is seen in the facilitated insertion under comparatively low forces into the needle-housing bores due to the conical needle shaft shape.

What is claimed is:

1. An opening cylinder for open-end spinning machines, which comprises a cylindrical ring (1) serving as a needle support for needles and needle-carrying bores (3) which extend from an inner ring surface (1*a*) to an outer ring surface (1*b*), each of said needles comprising a point section (2*b*) of generally tapered shape and a shaft section (2*a*), said bores comprising an inner section (3*a*) receiving at least partially said shaft section of the corresponding needle with force fit and an outer section (3*b*) surrounding a portion (2*b*′) of said point section (2*b*) of the corresponding needle, said inner section (3*a*) of the bore having at least partially a diameter which is greater than the diameter of the outer section (3*b*) of the bore in the range of its orifice in the outer ring surface (1*b*), said outer section (3*b*) of the bore surrounding said portion (2*b*′) of said needle point section (2*b*) at a distance so as to form an annular groove (4) therewith.

2. An opening cylinder according to claim 1, in which said generally tapered needle point section (2*b*) has an at least partially concave profile as viewed in a direction transverse to the needle axis.

3. An opening cylinder according to claim 2, in which the surface of said generally tapered needle point section (2*b*) is defined at least partially by the rotation of a generatrix about the needle axis, the slope of said generatrix against the needle axis being degressive continuously or by sections or steps in a direction from the base (2*d*) to the tip (2*c*) of the point section.

4. An opening cylinder according to claim 2 or 3, in which the portion (2*b*″) of the needle point section which protrudes over the outer ring surface (1*b*) is approximately conical and in which the portion (2*b*′) of the the needle point section which joins said needle shaft section (2*a*) broadens progressively in the direction towards said needle shaft section.

5. An opening cylinder according to claim 4, in which the relation between the maximum diameter and the length of said conical portion (2*b*″) of said needle point section (2*b*) is approximately 1:5, the length of the adjacent portion (2*b*′) of said needle point section joining the needle shaft section (2*a*) being approximately 40% of the length of said conical portion (2*b*″), and in which the diameter of said adjacent portion (2*b*′) changes in the direction towards said needle shaft section in such a manner that it is twice as great as its end as at its beginning.

6. An opening cylinder according to anyone of claims 1, 2, or 3, in which said bore (3) has a needle shaft section (2*a*) pressed therein, the surface of said bore having a bead or shoulder (3*c*) extending at least partially in a peripheral direction, said bead or shoulder being located axially in front of and generated by a circumferential edge portion (2*d*) between the point and shaft sections of the needle, said bead or shoulder protruding radially inwards over an undeformed bore surface (3*b*).

7. An opening cylinder according to anyone of claims 1, 2, or 3, in which the axial length of said needle shaft section (2*a*) is substantially ⅔ of the length of the bore (3).

8. An opening cylinder according to anyone of claims 1, 2, or 3, in which the shape of said needle shaft section is substantially cylindrical.

9. An opening cylinder according to anyone of claims 1, 2, or 3, in which the shape of said needle shaft section is substantially frusto-conical with a diameter slightly decreasing in the direction to the tip (2*c*) of the needle.

10. An opening cylinder according to anyone of claims 1, 2, or 3, in which the shape of said bore in a state before a needle having been inserted is substantially cylindrical.

11. An opening cylinder according to anyone of claims 1, 2, or 3, in which the shape of said bore is substantially conical with a diameter slightly decreasing in the direction to the tip (2*c*) of the needle.

12. An opening cylinder according to claim 11, in which said bore has at the inner ring surface (1a) a diameter (d1) which is approximately 5% greater than its diameter (d2) at the outer ring surface (1*b*).

* * * * *